US011395375B2

(12) United States Patent
Salahub

(10) Patent No.: US 11,395,375 B2
(45) Date of Patent: Jul. 19, 2022

(54) ELECTRIC HEATING DEVICE

(71) Applicant: Eberspächer catem GmbH & Co. KG, Herxheim (DE)

(72) Inventor: Daniil Salahub, Bad Schönborn (DE)

(73) Assignee: Eberspächer catem GmbH & Co. KG, Herxheim (DE)

( * ) Notice: Subject to any disclaimer, the term of this patent is extended or adjusted under 35 U.S.C. 154(b) by 0 days.

(21) Appl. No.: 17/076,283

(22) Filed: Oct. 21, 2020

(65) Prior Publication Data

US 2021/0127456 A1 Apr. 29, 2021

(30) Foreign Application Priority Data

Oct. 25, 2019 (DE) ..... 10 2019 216 481.1

(51) Int. Cl.

| | |
|---|---|
| ***H05B 3/06*** | (2006.01) |
| ***H05B 3/10*** | (2006.01) |
| *H05B 3/78* | (2006.01) |

(52) U.S. Cl.

CPC ..... *H05B 3/06* (2013.01); *H05B 3/78* (2013.01); *H05B 2203/016* (2013.01); *H05B 2203/02* (2013.01); *H05B 2203/021* (2013.01)

(58) Field of Classification Search

None

See application file for complete search history.

(56) References Cited

U.S. PATENT DOCUMENTS

| | | | | |
|---|---|---|---|---|
| 4,223,208 | A | 9/1980 | Kleinschmidt et al. | |
| 4,331,861 | A * | 5/1982 | Meixner | H01C 1/1406 219/505 |
| 2016/0360573 | A1* | 12/2016 | Bohlender | H05B 3/06 |
| 2017/0295613 | A1* | 10/2017 | Kim | B60H 1/2221 |
| 2019/0289673 | A1* | 9/2019 | Magnier | H01R 4/58 |
| 2020/0340708 | A1* | 10/2020 | Walz | F24H 1/121 |
| 2021/0033303 | A1* | 2/2021 | Kachelhoffer | F24H 3/0441 |

(Continued)

FOREIGN PATENT DOCUMENTS

| | | |
|---|---|---|
| EP | 1872986 | 1/2008 |
| EP | 1872986 A1 | 1/2008 |
| EP | 1921896 A1 | 5/2008 |

(Continued)

*Primary Examiner* — Joseph M. Pelham

(74) *Attorney, Agent, or Firm* — Boyle Fredrickson S.C.

(57) ABSTRACT

An electric heating device includes a housing having a partition wall which separates a connection chamber from a heating chamber for dissipating heat and from which at least one receiving pocket protrudes into the heating chamber as a heating rib that may taper towards its lower closed end. A PTC heating element is received in the receiving pocket. The PTC element includes at least one PTC element and conductor tracks which energize the PTC element with different polarities which are electrically conductively connected to the PTC element, and which are electrically connected in the connection chamber. A pressure element also is received in the receiving pocket. Heat extraction surfaces of the PTC element are held in the receiving pocket abutting against oppositely disposed inner surfaces of the receiving pocket. The pressure element has at least one cambered surface segment projecting toward the inner surface or toward the PTC element.

9 Claims, 4 Drawing Sheets

(56) References Cited

U.S. PATENT DOCUMENTS

2021/0037615 A1* 2/2021 Walz ..... H05B 3/06

FOREIGN PATENT DOCUMENTS

| | | | | |
|---|---|---|---|---|
| EP | 2337425 | | 6/2011 | |
| EP | 2337425 | A1 | 6/2011 | |
| EP | 2637474 | | 9/2013 | |
| EP | 2637474 | A1 * | 9/2013 | ..... H05B 3/02 |
| EP | 2637474 | A1 | 9/2013 | |
| EP | 3101365 | A1 | 12/2016 | |
| EP | 3101365 | B1 * | 12/2019 | ..... B60H 1/2221 |

* cited by examiner

ELECTRIC HEATING DEVICE

BACKGROUND OF THE INVENTION

1. Field of the Invention

The present invention relates to an electric heating device with a housing having a partition wall which separates a connection chamber from a heating chamber for dissipating heat. At least one receiving pocket protruding into the heating chamber as a heating rib protrudes from the partition wall. A PTC heating element is provided in this pocket. Furthermore, a pressure element is accommodated in the pocket and holds heat extraction surfaces of the PTC element abutted against opposite inner surfaces of the receiving pocket.

The PTC heating element has at least one PTC element and conductor tracks abutting thereagainst in an electrically conductive manner. The conductor tracks are connected to the PTC element in an electrically conductive manner. This connection can be a positive-fit and/or force-fit and/or positive substance-fit connection.

2. Background of the Invention

The aforementioned general features of the electric heating device apply to the prior art according to EP 1 872 986 A1. They also apply to the implementation of the invention.

The earlier proposals EP 2 637 474 A1 and EP 2 337 425 A1, respectively, originating from the applicant each disclose PTC heating elements which are introduced into a previously mentioned receiving pocket.

EP 2 337 425 A1 discloses a solution in which a conductor track abutting against a main side surface of the PTC element is provided as a piece of sheet metal with contact projections bent out of the plane of the piece of sheet metal. The contact projections only serve to improve the electric contact of the PTC element.

SUMMARY

With the solutions described above, the PTC elements and the contact plates abutting thereto on both sides are typically braced with a wedge-shaped pressure element, with the interposition of at least one insulating layer, between the conductor tracks and the oppositely disposed inner surface of the receiving pocket in the latter. With a receiving pocket tapering towards its lower closed end, this wedge element ensures that the layers of the layer structure are clamped against one another. These layers are at least the PTC elements and the conductor tracks extending at right angles to the direction of force action of the wedge element, usually contact plates, and at least one insulating layer.

Despite the production-related cross-sectional shape of the receiving pocket tapering downwardly, the wedge element is to enable good heat transfer between the two mutually opposite heat extraction surfaces of the PTC element and the respective inner surfaces of the receiving pocket associated therewith with the interposition of the pressure element. Due to the pressure built up there, the oppositely disposed heat extraction surface of the PTC element is abutted directly or with the interposition of the insulating layer against the oppositely disposed inner surface of the receiving pocket.

This ensures good heat extraction. However, there is the problem that the receiving pocket does not always correspond to the designed shape due to manufacturing tolerances.

For production reasons, the PTC elements are subject to considerable dimensional fluctuations. It is also not always ensured that the heat extraction surfaces of the PTC element run completely straight and planar.

The present invention seeks to provide a solution that remedies all or some of these issues.

For this purpose, an electric heating device includes a housing having a partition wall which separates a connection chamber from a heating chamber for dissipating heat and from which at least one receiving pocket, protruding into the heating chamber as a heating rib that may taper towards its lower closed end, protrudes. A PTC heating element is received in the receiving pocket. The PTC element includes at least one PTC element and conductor tracks which energize the PTC element with different polarities which are electrically conductively connected to the PTC element, and which are electrically connected in the connection chamber. Heat extraction surfaces of the PTC element are held in the receiving pocket abutting against oppositely disposed inner surfaces of the receiving pocket by a pressure element.

The pressure element has at least one cambered surface segment projecting in the direction toward the inner surface and or in the direction toward the PTC element. In a cross-sectional view of the receiving pocket, the cambered surface segment extends substantially parallel to the heat extraction surface of the PTC element. The heat path from the PTC element to the outer side of the heating rib takes place accordingly through the cambered surface segment. The heat typically enters the pressure element through the cambered surface of the cambered surface segment and exits on the side of the pressure element opposite thereto. The pressure element can abut directly against the inner surface of the receiving pocket and on the oppositely disposed side to the PTC element against the previously mentioned insulating layer in order to prevent direct electrical contact between the conductor track and the heating rib, which is typically formed from metal.

The pressure element is typically also wedge-shaped. In the vertical direction of the receiving pocket, the end of the pressure element oriented toward the lower, usually closed end accordingly has a smaller width than the oppositely disposed end of the pressure element oriented towards the connection chamber. The pressure element according to an embodiment of the present invention is therefore preferably a wedge-shaped pressure element. Compared to prior art, however, the pressure element has no planar surfaces with which the pressure element abuts, firstly, against the inner surface of the receiving pocket and, secondly, directly against the layer structure.

Surprisingly, it has been found that, even when using an idealized wedge-shaped receiving pocket with slightly diverging but planar-shaped inner surfaces, a cambered surface segment, which dissipates the heat generated by the PTC element to the inner surface of the receiving pocket, ensures better heat extraction than the solutions known from prior art. In addition, the cambered surface segment brings about a raised locking function of the pressure element, so that, even in a wedge-shaped configuration, it is not forced out of the receiving pocket as easily due to vibrations of the motor vehicle or other influences, as is to be feared in prior art.

The heat extraction surface of the PTC element is there typically formed by the main side surface of the same. This main side surface is typically larger at least by a factor of 3 than face surfaces which connect the heat extraction surfaces to one another and typically form the circumferential surface of the regularly cuboid-shaped PTC element.

In the case of a wedge-shaped configuration of the pressure element, the main side surfaces of the pressure element, which are formed substantially parallel to the inner surfaces of the receiving pocket, can form an angle of between 3° and 6°.

According to a preferred development of the present invention, oppositely disposed sides of the pressure element, i.e. the aforementioned main side surfaces of the pressure element, can each comprise a cambered surface segment. The cambered surface segment can extend over the entire or almost the entire main side surface of the pressure element.

However, it has proven to be advantageous to provide both a cambered surface segment as well as a planar surface segment consecutively in the vertical direction of the receiving pocket, where the planar surface segment is arranged deeper in the receiving pocket than the cambered surface segment. The cambered surface segment typically takes up more than 50% of the extension in terms of surface area of the respective main side surface of the pressure element. The cambered surface segment typically takes up between five sixths and four ninths of the extension of the pressure element in the height direction of the receiving pocket. In view of clamping the layered structure well in the receiving pocket and good heat dissipation, it has proven to be advantageous to provide the cambered surface segment over a height of approximately two thirds of the total height extension of the pressure element. The remaining height is assumed by the planar surface segment.

The pressure element is preferably configured symmetrically in a cross-sectional view. The same applies preferably to the configuration of the inner surface of the receiving pocket. The symmetry in the cross-sectional view of the receiving pocket arises here as well.

According to a preferred development of the present invention, the inner surface of the receiving pocket also has a cambered profile. The pressure element comprises a convex surface segment as a cambered surface segment which projects beyond an imaginary planar surface on the outside of the pressure element. The camber of the inner surface is typically convex, but at least formed as a projection projecting in the direction toward the pressure element. Individual surface segments of the projection can there have a straight-lined surface extension. For example, the inner surface can be shaped like a ramp, at least where the pressure element abuts against the inner surface. Surprisingly, it has shown that the heat extraction from the PTC element can be improved even with such a combination of two projecting surface regions.

In view of the desired good heat dissipation and the secure clamping of the layer structure in the receiving pocket, it has proven to be advantageous to design the cambered surface segment with a radius of between 500 and 1,000 mm. In the assembled state, the pressure element preferably sits on the base of the receiving pocket. The upper end of the pressure element can have a spacing of between 0 and 4 mm from the surface of the partition wall which forms the base of the connection chamber.

With a convex shape, the radius of the camber of the inner surface can be between 500 mm and 1000 mm.

The pressure element typically abuts against the PTC element with the interposition of a conductor track.

However, the pressure element can also cause the layers of the layer structure to be braced, and it can also be the conductor track of the layer structure and then abut directly against the heat extraction surface of the PTC element. In this configuration, the pressure element forms one of the conductor tracks. The pressure element and the conductor tracks are embodied by a single element. When operating the electric heating device with the normal vehicle electrical system voltage of 12 V, such a pressure element can, for example, connect the PTC element in a directly conductive manner to the inner surface of the receiving pocket which can connect to ground and is electrically conductively connected to a ground connection that is provided by the electric heating device. An insulating layer that separates the current path from the housing and thus from the receiving pocket can be dispensed with for voltages up to 25 VAC or up to 60 VDC.

The pressure element can also abut against the inner surface of the receiving pocket with the interposition of an insulating strip as the insulating layer and/or be provided with an electrical contact element which is exposed in the connection chamber of the electric heating device. In such a case, the power current is introduced into or discharged from the PTC element from the connection chamber via the pressure element and is electrically insulated from the receiving pocket.

The partition wall of the electric heating device can be formed integrally with the receiving pocket. This embodiment lends itself to an electric heating device in which a housing lower part defines a circulation chamber into which the receiving pocket protrudes in the manner of a heating rib and forms the inlet and outlet openings for the flow of a medium to be heated in the heating chamber, where the corresponding housing part is produced by way of extrusion or die-casting aluminum. In this respect, a preferred embodiment of the electric heating device according to the invention corresponds to the embodiment described in EP 1 872 986 A1. The same applies to the electrical connection of the conductor tracks in the connection chamber which is provided on the side of the partition wall opposite the circulation chamber and typically electrically connects several PTC heating elements via a printed circuit board and/or via a control device provided in the connection chamber to the PTC heating elements enables actuating individual or all PTC heating elements of the electric heating device. For this purpose, the conductor tracks typically have connection lugs which on their free portion project over the receiving pocket and are exposed in the connection chamber. The conductor tracks can be formed in a manner known per se by contact plates which form said connection lug at their free end.

The pressure element as such should be made of a material with good thermal conductivity. The pressure element is preferably formed from copper or brass.

According to a preferred development of the present invention, a heater casing made of insulating material is provided and joins the PTC element and the conductor tracks to form a unit and guides the pressure element in a slideable manner. Such a heater casing typically consists of insulating material, such as plastic material or ceramic material. For guiding the pressure element, the heater casing has a sliding guide which extends substantially in the vertical direction. The heater casing can be adhesively bonded to one or both conductor tracks. It is also possible to injection-mold-coat the conductor tracks with the interposition of the PTC element(s) during the injection molding process of manufacturing the heater casing from plastic material. This creates one entity. The sliding guide typically has mutually opposite guide slots in which an edge region of the sheet metal strip comprising no spring segments is guided in a slidable manner. The heater casing can also accommodate the at least one insulating layer and positions it relative to the contact plate. The heater casing can also have a sliding plate provided between the heat extraction surface of the PTC element and the pressure element in order to obtain further uniformity of the contact pressure which is caused by the individual spring segments. However, the present invention may do so without such a sliding plate, since the configuration of the spring segments and the thickness of the sheet metal strip are selected such that the rather punctiform pressure load caused by each individual spring segment remains subcritical, so that mechanical damage to the PTC element and/or other layers of the layer structure, in particular the insulating layer, is not to be feared.

In order to improve the thermal conductivity in the region of the pressure element, it is proposed according to a preferred development of the present invention to fill with thermally conductive material the free spaces which are pressed free by the spring segments within the receiving pocket. This thermally conductive material is preferably a thermally high-conductive mass. The thermal conductivity should be at least 3 W/(m K). The mass is typically of such nature that it allows for a certain motion of the PTC heating element in the receiving pocket to compensate for thermal stresses that occur during the typical temperature changes. Filling in of the material should be made after the PTC heating element has been inserted into the receiving pocket and after the pressure element has been pushed in the vertical direction relative to the layers of the layer structure and for bracing the same in the receiving pocket when the PTC heating element is positioned relatively in the receiving pocket In other words, the PTC heating element is first introduced into the receiving pocket. The pressure element is thereafter introduced into the receiving pocket or, if the pressure element has already been introduced with the PTC heating element into the receiving pocket, is pushed relative to the layer structure in order to preload the layer The pressure element according to the invention also may have the wedge shape described above, at least when the housing is manufactured by way of pressure die casting. Because a wedge-shaped receiving pocket can hardly be avoided with this method. However, the present invention can also be implemented with non-wedge-shaped receiving pockets. The spring segments can each be configured in such a way that they resemble a planar contact surface with their contact points or surfaces, or they abut against a contoured or randomly inclined surface, and trace the latter's contours via abutment points or surfaces formed by the individual spring segments.

Once the layers of the layer structure have been braced in the receiving pocket by the pressure element, the mass is filled into the pocket. This mass preferably fills all the free spaces in the pocket so that good heat transfer from the PTC element to all inner surfaces of the pocket arises, including the end faces thereof. The mechanical bracing is maintained by the spring segments of the pressure element. The mass is preferably a permanently elastic mass, so that a certain flexibility of the mass is also given and the spring segments can also follow certain compensatory motions during operation which arise, for example, due to the thermal expansion of the individual layers of the layer structure. A suitable mass is e.g. two-component silicone which can be filled with ceramic particles to improve thermal conductivity.

The cambered surface segment of the pressure element preferably terminates with a spacing from an upper and/or lower end of the pressure element. A depression is provided between the cambered surface segment and a surface segment adjacent thereto. The adjacent surface segment can be a planar or convex surface segment. The depression typically adjoins the cambered surface segment and the adjacent surface segment in a stepless manner. The depression is located within a tangent to the cambered surface segment and the adjacent surface segment. The depression can be used to apply an adhesive reservoir to the surface of the pressure element in the depression during production. This adhesive reservoir can be arranged, for example, between a leading surface segment and the cambered surface segment, so that the adhesive is distributed on the pressure element and/or the inner surface when the pressure element is inserted into the receiving pocket.

BRIEF DESCRIPTION OF THE DRAWINGS

Further details and advantages of the present invention shall become apparent from the following description of an embodiment in combination with the drawing, in which.

DETAILED DESCRIPTION

Figure 1:
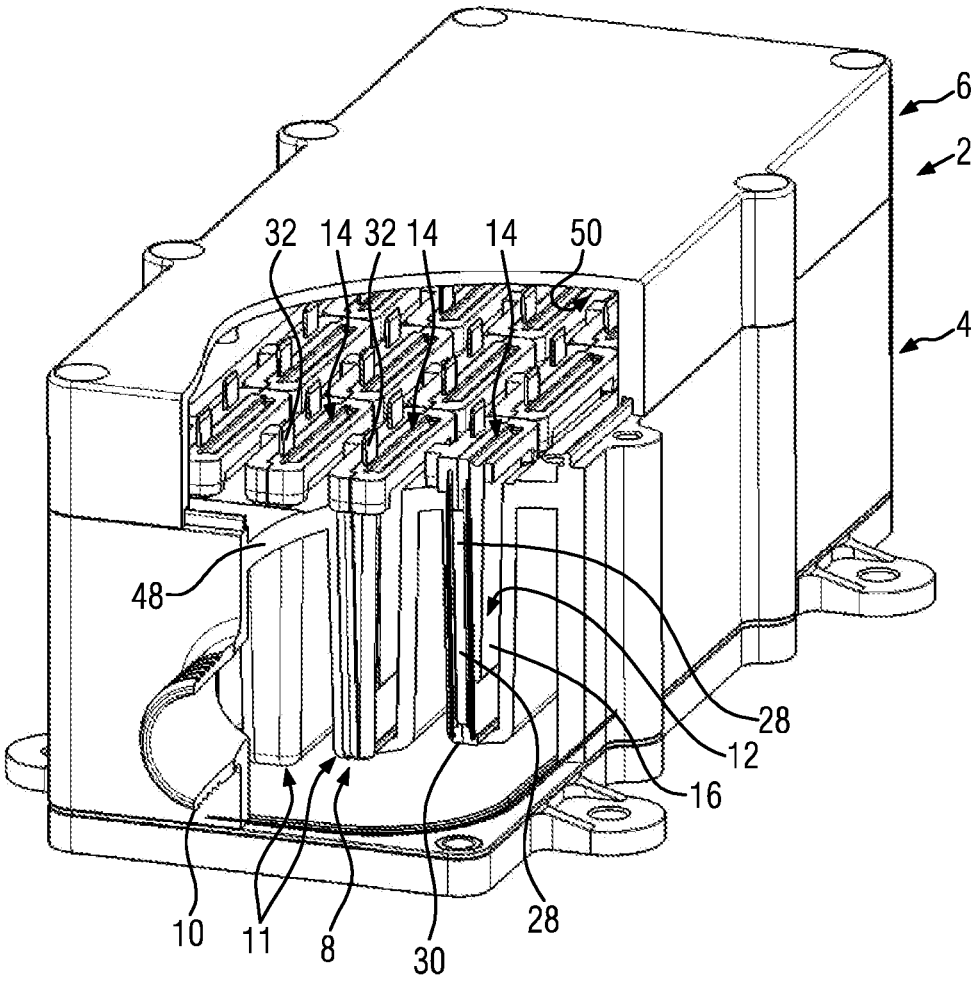
FIG. 1 shows a perspective face side view of an embodiment of an electric heating device with the housing partially removed.

FIG. 1 shows an embodiment of an electric heating device with a housing 2 having a housing base 102 and a housing cover 6. The housing base 4 surrounds a heating chamber 8 which is connected via ports, of which only one port 10 is shown, to a line for fluid to be heated. The heating chamber 8 is penetrated by several heating ribs 11 which extend in the longitudinal direction of the housing base 4 and which in the cross-sectional view form a substantially U-shaped, slightly conically tapering receiving pocket 12 and are circumferentially closed with respect to the heating chamber 8. These receiving pockets 12 have a depth that is greater than the extension of PTC heating elements 14 in the longitudinal direction of the receiving pocket 12.

The embodiment of an electric heating device shown has four adjacently disposed receiving pockets 12 which extend substantially over the entire length of the housing base 4. The housing base 4 is formed as a die-cast member made of aluminum. For further details on the electric heating device, reference is made to the applicant's EP 1 921 896 A1.

When the housing cover 6 is removed, several PTC heating elements 14 are introduced one next to one another in the individual receiving pockets 12. Details of these PTC heating elements 14 can be found, for example, in the applicant's EP 2 637 474 A1, the subject matter of which is incorporated by reference. This earlier disclosure also provides details on a pressure element denoted with reference numeral 16 in the drawing.

Figure 4:
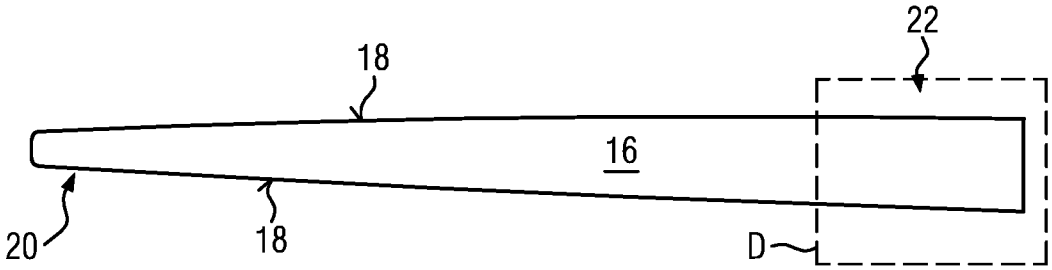
FIG. 4 shows an enlarged side view of the pressure element according to FIG. 4.
Figure 5:
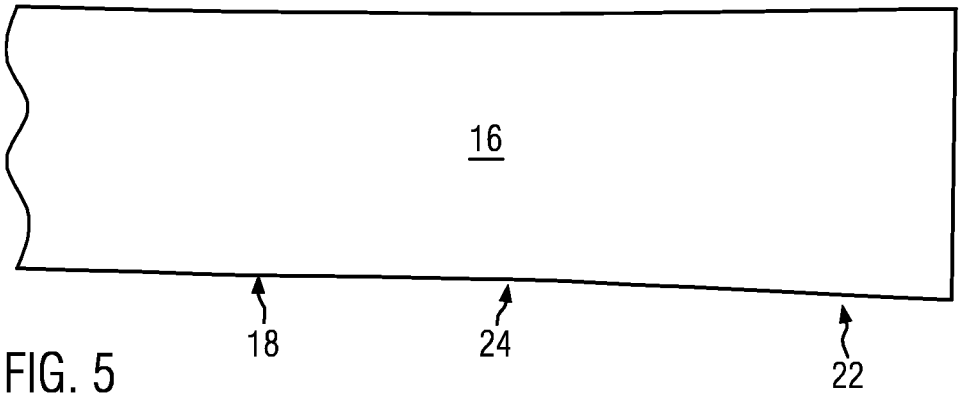
FIG. 5 shows an enlarged detail D according to FIG. 4.

Like in the disclosure of EP 2 637 474 A1, the pressure element 16 is also wedge-shaped in the present case. The pressure element 16 has a special surface configuration which shall be discussed in more detail below. As illustrated in FIG. 4, the pressure element 16 has a cambered surface segment 18 on each oppositely disposed main sides. A planar surface segment 20 defining the lower end of the pressure element 16 projects over this surface segment 18 at the lower, thinner end of the pressure element 16. Formed at the oppositely disposed end of the pressure element 16 is a further planar surface segment 22 which forms the thicker end of the wedge-shaped pressure element 16. A respective depression 24 is formed between the cambered surface segment 18 and the adjacent planar surface segments 20, 22 and is illustrated in particular in FIG. 5. The depression 24 is formed where the conically formed planar surface segment 20, 22 adjoins the radius of the cambered surface segment 18. The respective surface segments 18, 20, 22 transition steplessly and continuously into one another.

Figure 6:
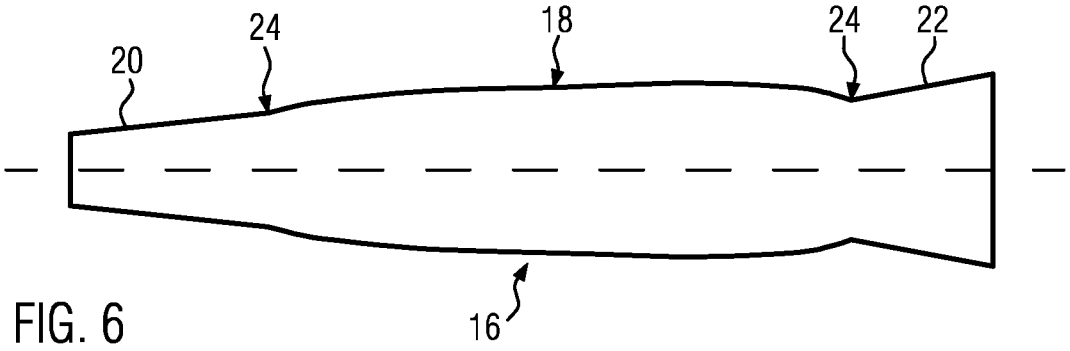
FIG. 6 shows an exaggerated side view of the pressure element.

A representation of the respective cross-sectional geometry of the pressure element 16 exaggerating the actual geometric relationships can be gathered from FIG. 6.

Figure 2:
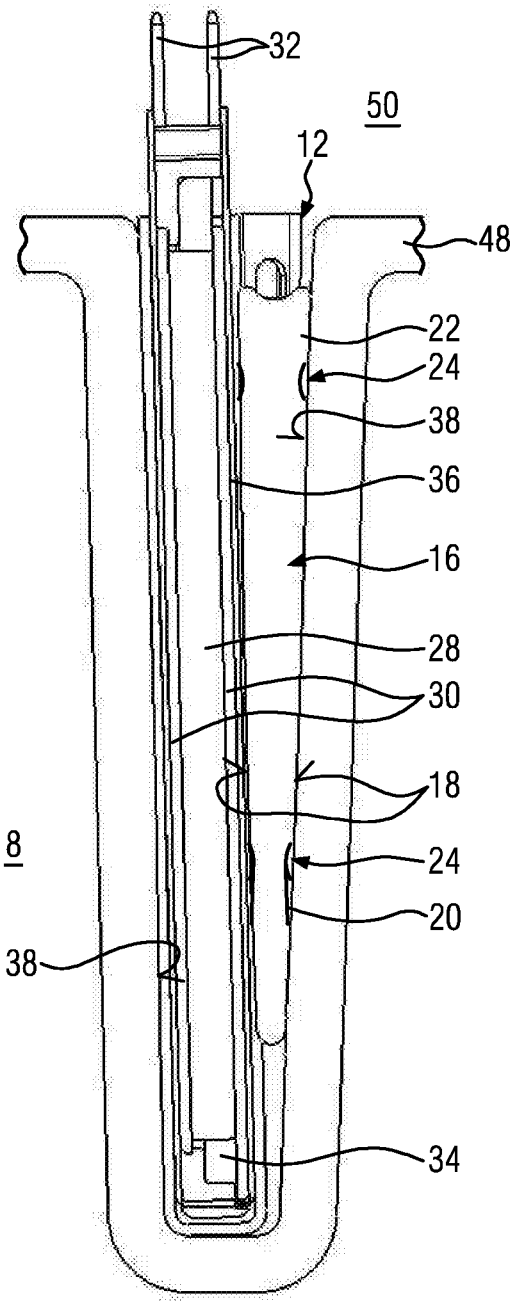
FIG. 2 shows a cross-sectional view of a heating rib of the embodiment shown in FIG. 1 with a partially simplified heater casing.
Figure 3:
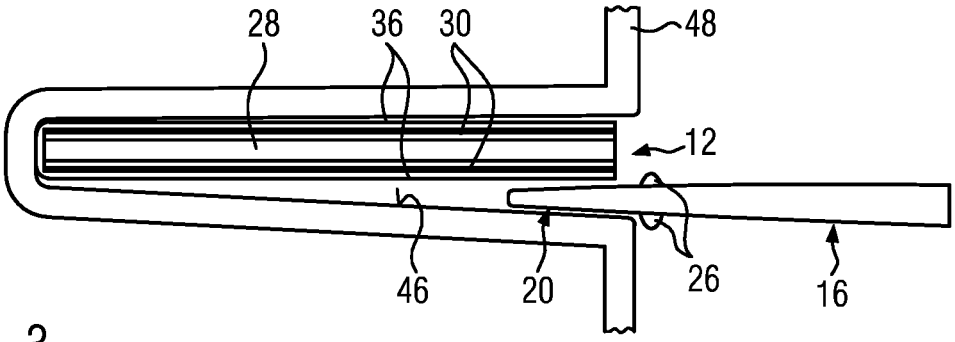
FIG. 3 shows a simplified cross-sectional view approximately according to FIG. 2 before the pressure element is introduced into the receiving pocket.

The depression 24 forms a receiving region for an adhesive 26 which can be recognized as an adhesive droplet within the receiving pocket 12 in FIG. 3 prior to the assembly of the pressure element 16. The PTC heating element 14 has already been introduced into the receiving pocket 12 shown schematically there. It comprises a single PTC element 28, the main side surfaces of which are each covered with a contact plate 30, which, for forming contact strips 32, are extended beyond a heater casing 34 which joins the PTC element 28 and the contact plates 30 as well as insulating layers denoted with reference number 36 to form one entity. The insulating layers 36 are located between one of the contact plates 30 and an inner surface 38 of the receiving pocket 12; cf. FIG. 2

In the embodiment shown in FIG. 3, the insulating layer 36 is formed by a Kapton film into which the PTC element 28 and the contact plates 30 abutting thereagainst are wrapped.

Figure 7:
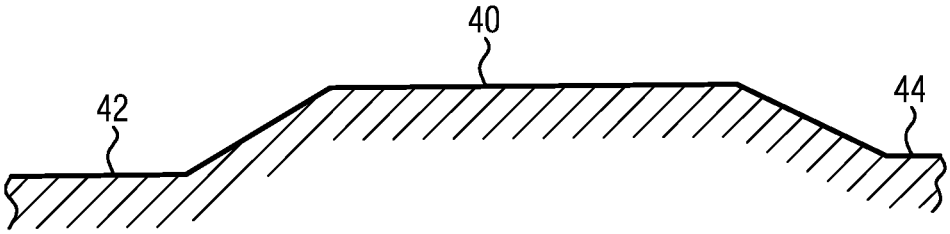
FIG. 7 shows a cross-sectional view of the receiving pocket in the region of the inner surface for a first variant.
Figure 8:
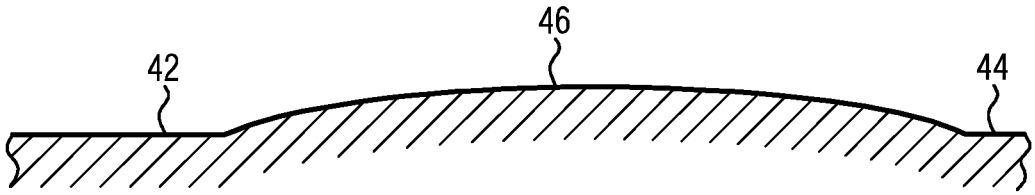
FIG. 8 shows a cross-sectional view of the receiving pocket in the region of the inner surface for a second variant.

FIGS. 7 and 8 show conceivable configurations of the inner surface 38 of the receiving pocket 12. According to FIG. 7, a ramp-shaped profile is shown which forms a projection with a planar surface segment 40 of the inner surface 38. When the pressure element 16 is received in the receiving pocket 12, the cambered surface segment 18 of the pressure element 16 abuts against this planar surface segment 40. The two other surface segments 20, 22 are located approximately at the level of a lower or respectively upper surface segment 42, 44 of the inner surface 38.

In the alternative embodiment according to FIG. 8, the central surface segment denoted there with reference numeral 46 is convex and therefore cambered. It extends from lower and upper planar surface segments 42, 44.

Surprisingly, it has been shown that improved heat extraction over the solutions described in prior art can be achieved even with the abutment of two cambered, i.e. each convexly shaped surface segments 18, 46 on both sides of the pressure element 16. The configuration also improves the pressure element 16 from being undesirably forced out of the receiving pocket 12 as a result of vibrations. Because the electric heating device is employed, in particular, as an electric heating device in a motor vehicle. Vibrations in a motor vehicle are a challenge for mechanical connections, also for pressure connections with the aid of a pressure element 16.

FIG. 3 shows the pressure element 16 prior to assembly. When pushing the pressure element 16 into the receiving pocket 12, the adhesive 26 interacts with the oppositely disposed surface, i.e. with the inner surface 38 or respectively an outer surface of the PTC heating element 14 formed by the insulating layer 36. The respective surfaces are there ideally completely wetted. At the end of the insertion motion of the pressure element 16 into the receiving pocket 12, good wetting with adhesive arises accordingly between the components to be adhesively bonded in the receiving pocket 12. The adhesive can be cured with higher strength and/or shorter curing time by applying temperature. For this purpose, the PTC heating element 14 can be energized.

At the end of the assembly, the PTC heating element 14 is wedged in by the pressure element 16, so that the main side surfaces of the PTC element 28 abut against the inner surfaces 38 of the receiving pocket 14 with good thermal conductivity. The contact strips 32 extended beyond the heater casing 34 are exposed in a connection chamber 50 of the housing 2 which is separated in FIG. 1 by a partition wall 48 in front of the heating chamber 8. In this connection chamber 50, the contact strips 32 of each individual PTC heating element 14 are electrically connected in the manner described, for example, in EP 1 921 896 A1, in order to group several of the PTC heating elements 14 to form a heating circuit and/or to connect the PTC heating elements 14 individually or in groups to a control device which is typically also provided in the connection chamber 50.

What is claimed is:

1. An electric heating device comprising:

a housing having a partition wall which separates a connection chamber from a heating chamber for dissipating heat and from which at least one receiving pocket protrudes, wherein the receiving pocket protrudes into the heating chamber as a heating rib;

a PTC heating element received in the receiving pocket, the PTC heating element including at least one PTC element and conductor tracks which are electrically conductively connected to the PTC element and which are configured to energize the PTC element with different polarities and which are electrically connected in the connection chamber, and a pressure element which is received in the receiving pocket and which holds a plurality of heat extraction surfaces of the PTC heating element abutted against oppositely disposed inner surfaces of the receiving pocket, wherein the pressure element has a wedge-shaped cross-sectional configuration, wherein the wedge shape is formed by opposite main side surfaces of the pressure element, and wherein at least one of said opposite main side surfaces of the pressure element has a cambered surface segment projecting in a direction toward the inner surface of the receiving pocket and/or in a direction toward the PTC element.

2. The electric heating device according to claim 1, wherein at least one respective cambered surface segment of the pressure element is provided on opposite sides of the pressure element.

3. The electric heating device according to claim 1, wherein a cambered surface segment of the pressure element and one of a planar surface segment or a concave surface segment extending in the vertical direction of the receiving pocket are provided consecutively, at least on one side of the pressure element, and wherein the planar or concave surface segment is arranged deeper in the receiving pocket than the cambered surface segment.

4. The electric heating device according to claim 1, wherein at least one of the inner surfaces of the receiving pocket comprises an inner surface segment projecting toward the pressure element.

5. The electric heating device according to claim 1, wherein the cambered surface segment of the pressure element has a radius (R) of between 500 and 1,000 mm.

6. The electric heating device according to claim 1, wherein at least one of the inner surfaces of the receiving pocket projects toward the pressure element.

7. The electric heating device according to claim 1, wherein the cambered surface segment of the pressure element terminates with a spacing from an upper or lower end of the pressure element and transitions via a depression to the cambered surface segment.

8. The electric heating device according to claim 1, wherein at least one of the inner surfaces of the receiving pocket comprises a cambered inner surface segment projecting in the direction toward the pressure element.

9. The electric heating device according to claim 1, wherein the receiving pocket tapers towards a lower, closed end, thereof.

* * * * *